United States Patent [19]

Reay

[11] 4,428,167

[45] Jan. 31, 1984

[54] VENTILATING MEANS

[75] Inventor: Alan Reay, Christchurch, New Zealand

[73] Assignee: The Fletcher Industries Limited, Auckland, New Zealand

[21] Appl. No.: 284,000

[22] Filed: Jul. 16, 1981

[51] Int. Cl.[3] ..... E04B 1/346

[52] U.S. Cl. ..... 52/72; 52/199

[58] Field of Search ..... 52/72, 66, 200, 199; 49/404, 405, 339, 344, 345, 357

[56] References Cited

U.S. PATENT DOCUMENTS 1,957,710 5/1934 Hennicke ..... 49/345 X
4,327,530 5/1982 Bush ..... 52/66

FOREIGN PATENT DOCUMENTS 223723 6/1910 Fed. Rep. of Germany ..... 52/72
270561 2/1914 Fed. Rep. of Germany ..... 52/72
606497 7/1960 Italy ..... 52/72

*Primary Examiner*—Carl D. Friedman
*Attorney, Agent, or Firm*—Holman & Stern

[57] ABSTRACT

A ventilating device which includes at least one ventilating section for running down the roof of a building or structure which is capable of being opened and closed to enable the structure to be ventilated, a support arm connected to the ventilating section to permit it to be moved into and out of a ventilating position and an actuating arm capable of movement relative to the support arm, so as to move the support arm and the ventilating section into and out of a ventilating position. The invention permits the actuating arm to be maintained in a predetermined position to hold the support arm and ventilating section in a position in which the ventilating section is in a substantially non-ventilating position.

8 Claims, 3 Drawing Figures

VENTILATING MEANS

BACKGROUND OF THE INVENTION

1. Field of the Invention

This invention relates to ventilation and more particularly to a device for actuating sections of roofs and walls of buildings, such as for example warehouses, glasshouses and the like.

2. Description of the Prior Art

Up until this time, it has been known to provide buildings such as, for example, warehouses and glasshouses, with ridge sections of a roof, which are movable relative to the remainder of the roof, so as to be spaced apart from the remainder of the roof and so as to permit the entry of air and the like for the purposes of ventilation. In a number of known arrangements, means are provided to enable such roof sections to move upwardly or outwardly of the main portion or remainder of the roof section, so as to provide a gap or space therebetween, to permit ventilation through that space. There have however been a number of problems in that such movable sections have been subject to wind lift, such that when they are not in use, wind and the like has been able to move under free edges, and to lift the sections into an open position, when ventilation has not been required.

This has been generally considered to be inefficient and troublesome.

BRIEF SUMMARY OF THE INVENTION

It is an object of this invention to overcome this problem.

According to one aspect of this invention there is provided ventilating means, including at least one ventilating section; a support arm extending away therefrom and being slidably engaged within an elongate housing; an actuating arm connected to an upper portion of said support arm and to, or adjacent, a lower portion of said elongate housing; a lower portion of the actuating arm being provided with a lug or flange, the arrangement being such, that on a predetermined or desired movement being applied to said actuaing arm the actuating arm causes the support arm to slide outwardly of the elongate housing to move the ventilating section into a ventilating position; the actuating arm in its position of rest, and in which position the support arm is withdrawn within the elongate housing and the ventilating section is in a substantially nonventilating position, being held in such a position by the flange or lug engaging with a lower portion of said elongate housing.

BRIEF DESCRIPTION OF THE DRAWINGS

This invention will now be described by way of example only, and with reference to the accompanying drawings, wherein.

DETAILED DESCRIPTION

The present invention will be described by way of example only, and it should be appreciated that improvements and modifications may be made to the invention without departing from the scope or spirit thereof.

Figure 1:
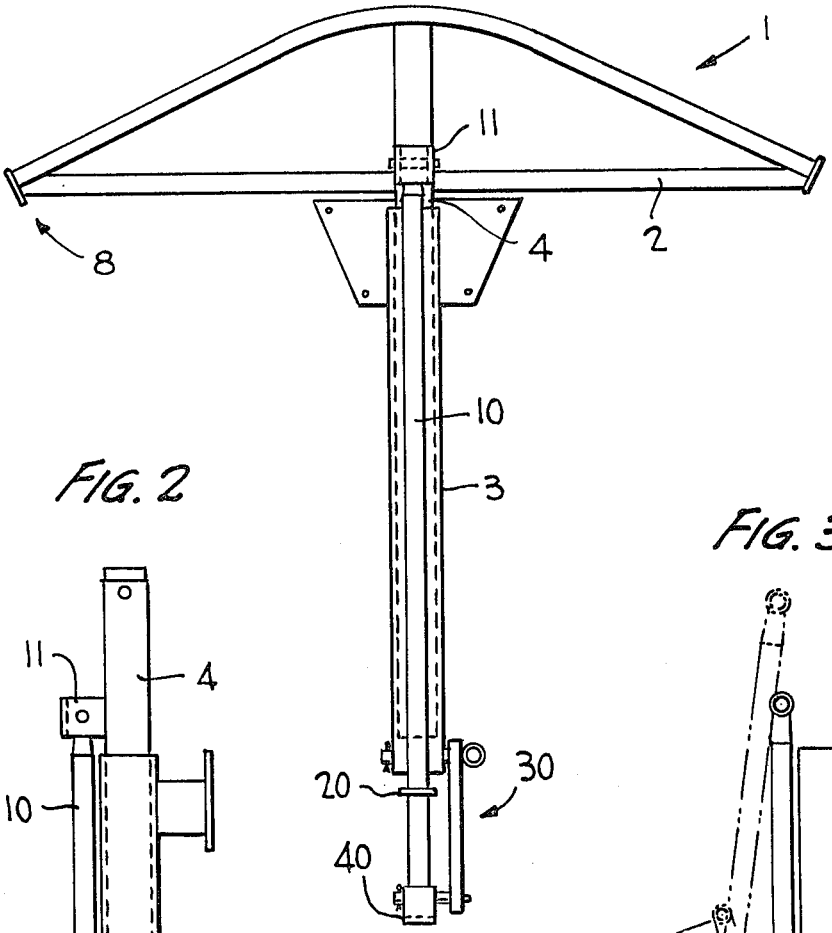
FIG. 1 is a elevational front view of an arrangement according to one form of the invention.

FIG. 1 of the accompanying drawings, shows by way of example only, a section of roofing 1, for example, an arcuate section of roofing which is adapted to be moved outwardly and away from similar sections of roofing, to cause a gap therebetween to permit for ventilating. The specification will be described by way of example only, with reference to the roofing section 1 being in a "ventilating position" and a "non-ventilating position". The term "ventilating position", should be defined as being that position in which a roofing section is moved outwardly or away from a similar section or sections, to provide a gap or space therebetween to permit ventilation. A "non-ventilating position", should be defined as being that position in which the ventilating section is in juxtaposition and substantially aligned with other sections of roofing, so as to prevent ventilation and so that the run of the roof or wall, is substantially continuous.

In this form of the invention, the roofing is substantially arcuate and the roofing section 1 is provided with a lower support cross bar 2. Attached to one of the uprights of a building, or to a beam, is a substantially elongate hollow tubular housing 3 which can be constructed of any suitable material such as metal and the like. This housing 3 is intended to slidably or telescopically locate a support arm 4 substantially elongate in form and attached to, so as to move it in and out of position, as may be desired, the ventilating section 8.

For the purposes of description and definition, the term "ventilating section" should be defined as that section of roofing which is moved into and out of position, relative to the rest of the roofing or walling, so as to permit ventilation.

An elongate actuating arm 10 is also provided externally of the elongate housing 3 and support arm 4 and in this form of the invention is pivotally at 11 to an upper portion of the support arm, such as in a "U" shaped pivot housing, with a pivot pin passing therethrough.

As will be appreciated from the accompanying drawings, the elongate actuating arm 10 extends downwardly substantially co-axially with the housing 3 and support arm 4 and is provided, adjacent its lower surface or end thereof, with a substantially radial or outwardly extending flange or lug or abutment lip 20.

Figure 2:
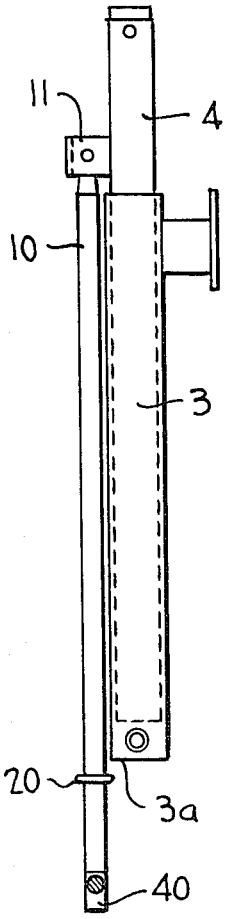
FIG. 2 is a right side view of the invention according to FIG. 1 with certain parts omitted for clarity.

It will be appreciated from FIG. 2 of the accompanying drawings, that in the position shown the downwardly extending actuating arm 10 will rest against or adjacent the housing 3 and the flange or lug or abutment lip 20 will be resting slightly under the lower end of the housing 3.

Thus, if in this closed position wind or some other force lifts under the ventilating section 8 of the roof or wall, and lifts it in an upward position, the flange 20 will abut and be caught under the lower end 3*a* of the housing 3, and this will prevent the ventilating section 8 from lifting open. This then overcomes the problems that have been associated with such roofing sections in the past.

In order to move the ventilating section 8 into a ventilating position, a lever arrangement 30 is provided in association with the housing 3 and actuating arm 10. This then permits the actuating arm 10 to be moved into an operative position, on a positive, predetermined or desired movement or moment being applied thereto.

In this form of the invention, the actuating arm is provided with a substantially bell crank type lever arrangement 30 or a lever of a substantially "L" shaped configuration. A first lever section 31 is pivotally mounted adjacent lower end 10*a* of the actuating arm 10 and extends upwardly, so as to be pivotally connected as at 33 to the lower end of the elongate housing 3. This then extends outwardly, at substantially right angles to the longitudinal axis of the first lever section, into a second lever section 34. The first and second lever sections are connected one to the other and pivotally connected to the housing 3, as at 33 in FIG. 3 of the drawings.

In use, on an upward pressure or force being applied to the second lever section 34, a pivotal moment will be imparted to the first lever section 31, which will move the actuating arm 10 outwardly and upwardly away from the housing 3, so that the flange or abutment lip 20 adjacent the lower end 10*a* of the actuating arm 10 will clear the bottom 3*a* of the housing 3, and will enable the actuating arm 10 to move the ventilating section 8 into an "open" ventilating position.

Figure 3:
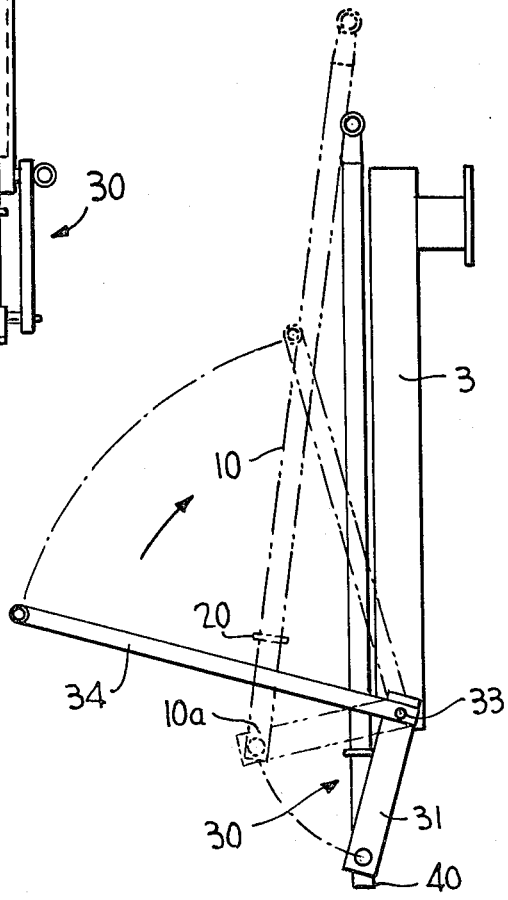
FIG. 3 is a further side view according to one form of the invention.

The lower end 10*a* of the actuating arm 10 is, in one form of the invention, provided with an elongate slot 40 to provide for slight lifting movement when the actuating arm 10 is in its position of rest (such as shown in FIG. 2 and in firm lines in FIG. 3 of the accompanying drawings).

Thus, some degree of lift may occur when wind or force is applied under the ventilating section 8 which will move the flange or abutment lip 20 into and out of position and contact with the lower end 3*a* of the housing 3.

Thus, the elongate slot 40 provides for this movement, and prevents any friction or undue pressure being applied to the pivot points and workings of the lever arrangement 30 for housing the actuating arm 10.

FIG. 3 of the accompanying drawings, shows the actuating arm 10 being moved outwardly and upwardly relative to the housing, in dotted lines by way of example only.

Suitable connecting rods may be attached to the end of the second lever arm 34 to provide for movement of the lever arm 34 into and out of position, for the movement of the actuating means 10. Ropes, wire, and the like can be used to permit operation of the invention. Alternatively, an elongate handle can extend away from the end of such connecting rods, to a position which permits operation by a user or operator.

In one form of the invention, and in particular in cases such as for example in warehouses, glasshouses and the like, a plurality of such actuating means may be provided along the length of the building, and the second lever arms 34 can be connected one to the other such as by a rod, so that they can be moved simultaneously and the ventilating sections opened simultaneously.

Alternatively, they can be operated independently such as by rods, levers, rope, chains and the like.

If desired, the actuation of said ventilating means can be by way of a prime mover of some suitable kind. For example, a motor air cylinder, hydraulic motor, hydraulic cylinder or the like.

It will be appreciated that this invention has been described by way of example only and that improvements and modifications may be made without departing from the scope thereof, as defined by the appended claims.

I claim:

1. A ventilating device comprising: at least one ventilating section; an elongated housing extending in a direction away from said section; a support arm slidably engaged within said elongated housing; means for engaging one end of said support arm with said section; an actuating arm connected to said support arm; means for linking said actuating arm to said elongated housing; and a flange on the actuating arm adjacent the end of said housing remote from said section; the arrangement being such that a predetermined movement applied to said actuating arm causes the support arm to slide outwardly of the elongate housing to move the ventilating section into a ventilating position; and the actuating arm it its position of rest, wherein the support arm is withdrawn within the elongate housing and the ventilating section is in a substantially non-ventilating position is held in such position by the flange engaging with said remote end of said elongate housing.

2. A ventilating device as claimed in claim 1 wherein the support arm is telescopically mounted within the housing.

3. A ventilating device as claimed in claim 1 wherein the actuating arm is pivotally connected to the support arm adjacent said ventilating section.

4. A ventilating device as claimed in claim 1 wherein said means linking said actuating arm to the housing comprises a lever permitting the actuating arm to be moved into an operative position, so as to move the ventilating section into a ventilating position, on a positive, predetermined movement being applied thereto.

5. A ventilating device as claimed in claim 4 wherein said lever is substantially "L" shaped in configuration comprising first and second lever sections connected at substantially right angles one to the other, the lever being pivotally mounted to the housing adjacent the connection between said first and second lever sections.

6. A ventilating device as claimed in claim 5 wherein the first lever section has its distal end pivotally connected to said actuating arm adjacent the end of the actuating arm remote from said ventilating section; the second lever section extending outwardly from the housing and the pivotal connection between the lever and the housing.

7. A ventilating device as claimed in claim 6 and further comprising an elongated slot provided in the actuating arm adjacent the end thereof remote from said section, said pivotal connection at the distal end of the first lever section being slidably disposed in said slot.

8. A ventilating device as claimed in claim 7 and further comprising operating means attached to the second lever section for operating said lever so that pivotal movement of the second lever section causes the actuating arm to move the support arm and thus the ventilating section into and out of a ventilating position.

* * * * *